US011672068B2

(12) United States Patent
Kuta et al.

(10) Patent No.: US 11,672,068 B2
(45) Date of Patent: Jun. 6, 2023

(54) LIGHTING DEVICE WITH STATE OF CHARGE BASED CONTROL

(71) Applicant: MILWAUKEE ELECTRIC TOOL CORPORATION, Brookfield, WI (US)

(72) Inventors: Jonathan Kuta, Milwaukee, WI (US); Benjamin Oliver Ryan Cabot, Milwaukee, WI (US); Jay J. Rosenbecker, Menomonee Falls, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/559,527

(22) Filed: Dec. 22, 2021

(65) Prior Publication Data

US 2022/0201823 A1 Jun. 23, 2022

Related U.S. Application Data

(60) Provisional application No. 63/129,016, filed on Dec. 22, 2020.

(51) Int. Cl.
*H05B 47/14* (2020.01)
*F21L 4/08* (2006.01)
(Continued)

(52) U.S. Cl.
CPC ..... *H05B 47/14* (2020.01); *F21L 4/085* (2013.01); *H05B 45/10* (2020.01); *F21Y 2115/10* (2016.08)

(58) Field of Classification Search
None
See application file for complete search history.

(56) References Cited

U.S. PATENT DOCUMENTS 5,036,444 A 7/1991 Hiles
5,871,272 A 2/1999 Sharrah et al.
(Continued)

FOREIGN PATENT DOCUMENTS

CN 1467994 A 1/2004
CN 1230040 C 11/2005
(Continued)

OTHER PUBLICATIONS

International Search Report and Written Opinion for Application No. PCT/US2021/064903 dated Apr. 25, 2022 (9 pages).

*Primary Examiner* — Dedei K Hammond
(74) *Attorney, Agent, or Firm* — Michael Best & Friedrich LLP

(57) ABSTRACT

A lighting device including a light source, an input device, a power source configured to provide power to the lighting device, and one or more electronic processors. The one or more electronic processors are configured to receive an input signal to illuminate the light source from the input device and determine a first state-of-charge of the power source. The electronic processors are further configured to determine a first illumination output value based on the determined first state of charge and initiate a first ramp-down operation of the light source from the first illumination output value. The first ramp-down operation is configured to reduce an output of the light source as a percentage of the first illumination intensity over time. The electronic processors are also configured to continue the first ramp-down operation until the output of the light source reaches a predetermined illumination intensity.

21 Claims, 9 Drawing Sheets

(51) Int. Cl.
*H05B 45/10* (2020.01)
*F21Y 115/10* (2016.01)

(56) References Cited

U.S. PATENT DOCUMENTS 6,053,936 A 4/2000 Koyama et al.
6,095,661 A 8/2000 Lebens et al.
6,179,431 B1 1/2001 Chien
6,231,370 B1 5/2001 Morin et al.
6,305,818 B1 10/2001 Lebens et al.
6,488,390 B1 12/2002 Lebens et al.
6,573,659 B2 6/2003 Toma et al.
6,702,452 B2 3/2004 Jigamian et al.
6,808,287 B2 10/2004 Lebens et al.
6,896,392 B2 5/2005 Jigamian et al.
6,909,250 B2 6/2005 Jigamian et al.
7,173,237 B2 2/2007 Palmer et al.
7,186,000 B2 3/2007 Lebens et al.
7,186,002 B2 3/2007 Matthews et al.
7,196,477 B2 3/2007 Richmond
D541,962 S 5/2007 Bayat et al.
D544,620 S 6/2007 Son
D554,781 S 11/2007 Shiu
7,344,270 B2 3/2008 Kim
7,393,119 B2 7/2008 Lebens et al.
7,420,153 B2 9/2008 Palmer et al.
7,429,827 B2 9/2008 Richmond
7,517,107 B2 4/2009 Dallas et al.
7,581,852 B2 9/2009 Kennedy et al.
7,737,655 B1 6/2010 Devaney et al.
7,740,371 B1 6/2010 Lebens et al.
7,795,574 B2 9/2010 Kennedy et al.
7,850,330 B2 12/2010 Spartano et al.
7,888,883 B2 2/2011 Crawford et al.
7,942,553 B2 5/2011 Huang
7,959,317 B2 6/2011 Spartano et al.
7,976,189 B2 7/2011 Osborn
8,063,607 B2 11/2011 Crawford et al.
8,104,915 B1 1/2012 Osterhout et al.
8,115,492 B2 2/2012 Crawford et al.
8,120,268 B2 2/2012 Spartano et al.
8,134,300 B2 3/2012 Maglica et al.
8,159,146 B1 4/2012 Lebens et al.
8,197,085 B2 6/2012 Spartano
8,324,836 B2 12/2012 Crawford et al.
8,362,700 B2 1/2013 Richmond
8,362,712 B1 1/2013 Lebens et al.
8,414,142 B2 4/2013 Tucker et al.
8,628,210 B2 1/2014 Tucker et al.
8,643,305 B2 2/2014 Lebens et al.
8,708,560 B2 4/2014 Kraemer
8,717,034 B2 5/2014 Crawford et al.
8,727,561 B2 5/2014 Sharrah et al.
D708,376 S 7/2014 Crowe et al.
8,779,683 B2 7/2014 Snyder et al.
8,810,191 B2 8/2014 Maldonado
D713,076 S 9/2014 Von Waldthausen
8,829,808 B1 9/2014 Lebens et al.
8,853,951 B2 10/2014 Garcia
8,858,032 B2 10/2014 Van de Ven et al.
8,866,392 B2 10/2014 Chen
8,894,231 B2 11/2014 Kwok
D721,841 S 1/2015 Kwon et al.
8,975,822 B2 3/2015 Maglica et al.
D731,687 S 6/2015 Haws
9,101,022 B2 8/2015 Hoffman et al.
9,119,266 B1 8/2015 Lebens et al.
D739,063 S 9/2015 Su
D742,568 S 11/2015 Abernethy
9,179,520 B2 11/2015 Trattler
9,252,613 B2 2/2016 Kugel et al.
D757,318 S 5/2016 Evans
9,388,952 B2 7/2016 Patel et al.
D764,087 S 8/2016 Workman et al.
D766,477 S 9/2016 Ma
9,447,951 B2 9/2016 Maglica et al.
9,549,454 B2 1/2017 Maglica et al.
9,801,256 B2 10/2017 Maglica et al.
D805,666 S 12/2017 Nguyen et al.
9,851,088 B2 12/2017 Harvey et al.
D806,923 S 1/2018 Koshiba
D810,335 S 2/2018 Levy et al.
9,907,137 B1 2/2018 Lebens et al.
D819,245 S 5/2018 Gerza
D821,007 S 6/2018 Chen
10,001,252 B2 6/2018 Inskeep
10,066,827 B2 9/2018 Harvey et al.
D831,248 S 10/2018 Kuhls
10,091,854 B1 10/2018 Brandon, II
10,178,745 B2 1/2019 Hall et al.
D854,207 S 7/2019 Zheng
D855,228 S 7/2019 Cooper et al.
D857,958 S 8/2019 Willows et al.
D858,830 S 9/2019 Grandadam
D858,831 S 9/2019 Proeber
D858,833 S 9/2019 Cooper
D858,837 S 9/2019 Vazquez et al.
D861,209 S 9/2019 Cooper
10,412,805 B1 9/2019 Schwarz et al.
10,616,970 B2 4/2020 Johnson et al.
10,627,100 B2 4/2020 Harvey et al.
10,764,982 B2 9/2020 Johnson et al.
2003/0076051 A1 4/2003 Bowman et al.
2003/0234778 A1 12/2003 Kim
2005/0067983 A1 3/2005 Krieger et al.
2006/0038506 A1 2/2006 Rose et al.
2006/0043911 A1 3/2006 Shao et al.
2006/0072306 A1 4/2006 Woodyard
2006/0109662 A1 5/2006 Reiff et al.
2007/0014103 A1 1/2007 Teng et al.
2008/0225518 A1 9/2008 Devaney et al.
2008/0258642 A1 10/2008 Patel
2008/0304254 A1 12/2008 Canino et al.
2008/0309255 A1 12/2008 Myers et al.
2009/0085496 A1 4/2009 Osborn
2009/0085502 A1 4/2009 Geris et al.
2009/0086485 A1 4/2009 Osborn
2009/0196041 A1 8/2009 Joseph et al.
2010/0084997 A1 4/2010 Oberzeir et al.
2010/0085432 A1 4/2010 Kennedy et al.
2010/0264846 A1 10/2010 Chemel et al.
2011/0248648 A1 10/2011 Liu
2011/0266971 A1 11/2011 Osborn
2012/0033412 A1 2/2012 Molina et al.
2012/0126709 A1 5/2012 Beiner
2012/0182723 A1 7/2012 Sharrah et al.
2012/0182727 A1 7/2012 Sharrah et al.
2012/0182748 A1 7/2012 McCaslin et al.
2012/0286940 A1 11/2012 Carmen, Jr. et al.
2013/0141635 A1 6/2013 Lebens et al.
2013/0258649 A1 10/2013 Mueckl et al.
2014/0070728 A1 3/2014 Pflaum
2015/0131276 A1 5/2015 Thompson et al.
2015/0247628 A1 9/2015 Li
2015/0267902 A1 9/2015 Zhang
2016/0061429 A1 3/2016 Waalkes et al.
2016/0128151 A1 5/2016 Luick et al.
2016/0265754 A1 9/2016 Sun
2016/0295658 A1 10/2016 Chraibi et al.
2016/0339978 A1* 11/2016 Braucht ..... H05B 45/10
2017/0105265 A1 4/2017 Sadwick
2017/0284646 A1 10/2017 Arena et al.
2017/0292659 A1 10/2017 Bayat et al.
2018/0027627 A1 1/2018 Maglica et al.
2018/0156427 A1 6/2018 Bailey et al.
2018/0224077 A1 8/2018 Bian
2018/0266637 A1 9/2018 Curlett et al.
2018/0368222 A1 12/2018 Altenburger et al.
2019/0176679 A1 6/2019 Salter et al.
2019/0331326 A1 10/2019 Proeber et al.
2020/0015333 A1 1/2020 Ackermann et al.
2020/0178363 A1 6/2020 Zhang et al.

(56) References Cited

U.S. PATENT DOCUMENTS

| | | | |
|---|---|---|---|
| 2020/0196419 | A1 | 6/2020 | Johnson et al. |
| 2020/0208831 | A1 | 7/2020 | Harvey et al. |

FOREIGN PATENT DOCUMENTS

| | | | |
|---|---|---|---|
| CN | 101146388 | A | 3/2008 |
| CN | 201360368 | Y | 12/2009 |
| CN | 203942676 | U | 11/2014 |
| CN | 105744683 | A | 7/2016 |
| CN | 106303089 | A | 1/2017 |
| DE | 102016210199 | A1 | 12/2017 |
| EP | 2048431 | A1 | 4/2009 |
| EP | 2827684 | A1 | 1/2015 |
| KR | 1020140022185 | A | 2/2014 |
| KR | 2020160002590 | U | 7/2016 |
| WO | 2012158383 | A2 | 11/2012 |
| WO | 2016134396 | A2 | 9/2016 |
| WO | 2017031586 | A1 | 3/2017 |

* cited by examiner

LIGHTING DEVICE WITH STATE OF CHARGE BASED CONTROL

CROSS-REFERENCE TO RELATED APPLICATIONS

This application claims the benefit of, and priority to, U.S. Provisional Patent Application Ser. No. 63/129,016 filed Dec. 22, 2020, the entire contents of which are hereby incorporated by reference.

FIELD OF THE INVENTION

The present invention relates to lighting devices. More specifically, the present invention relates to portable lighting devices having adjustable light outputs.

SUMMARY

In one embodiment, a lighting device is described. The lighting device includes a light source, an input device, a power source configured to provide power to the lighting device, and one or more electronic processors. The one or more electronic processors are configured to receive an input signal to illuminate the light source from the input device and determine a first state-of-charge of the power source. The electronic processors are further configured to determine a first illumination output value based on the determined first state of charge and initiate a first ramp-down operation of the light source from the first illumination output value. The first ramp-down operation is configured to reduce an output of the light source as a percentage of the first illumination intensity over time. The electronic processors are also configured to continue the first ramp-down operation until the output of the light source reaches a predetermined illumination intensity.

In one embodiment, a method for operating a light source is described. The method includes receiving an input to illuminate the light source at a first illumination output value associated with a first operating mode and determining a first state-of-charge of a power source configured to provide power to the light source. The method also includes operating the light source at a second illumination output value based on the first operating mode and the determined first state-of-charge and initiating a first ramp-down operation of the light source from the second illumination output value. The first ramp-down operation is configured to reduce an output of the light source as a percentage of the second illumination output value over time. The method also includes receiving a first mode change input to change from the first operating mode to a second operating mode at a first time, wherein a third illumination output value is associated with the second operating mode. In response to receiving the first mode change input, determining a second state-of-charge of the power source, and controlling the output of the light source to output a fourth illumination output value, wherein the fourth illumination output value is based on the third illumination output value and the determined second state-of-charge. The method also includes initiating a second ramp-down operation of the light source from the fourth illumination output value, wherein the second ramp-down operation is configured to reduce the output of the light source as a percentage of the fourth illumination output value over time.

In one embodiment, a method for operating a light source is described. The method includes receiving an input to illuminate the light source at a first illumination output value associated with a first operating mode and determining a state-of-charge of a power source configured to provide power to the light source. The method also includes operating the light source at a second illumination output value based on the first operating mode and the determined state-of-charge and determining whether the second illumination output value exceeds a first predetermined threshold. The method also includes initiating a first ramp-down operation of the light source from the second illumination output value in response to determining that the second illumination output value exceeds the first predetermined threshold. The first ramp-down operation is configured to reduce an output of the light source as a percentage of the second illumination output value over time. The method also includes determining whether the second illumination output value exceeds a first predetermined threshold in response to determining that the second illumination output value does not exceed the first predetermined threshold. The method also includes initiating a second ramp-down operation of the light source from the second illumination output value in response to determining that the second ramp-down operation is configured to reduce an output of the light source as a percentage of the second illumination output value over time and maintaining the second illumination output value in response to determining that the second illumination output value does not exceed the second predetermined threshold.

DETAILED DESCRIPTION

Before any embodiments of the invention are explained in detail, it is to be understood that the application is not limited to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly to encompass both direct and indirect mountings, connections, supports, and couplings.

Figure 1A:
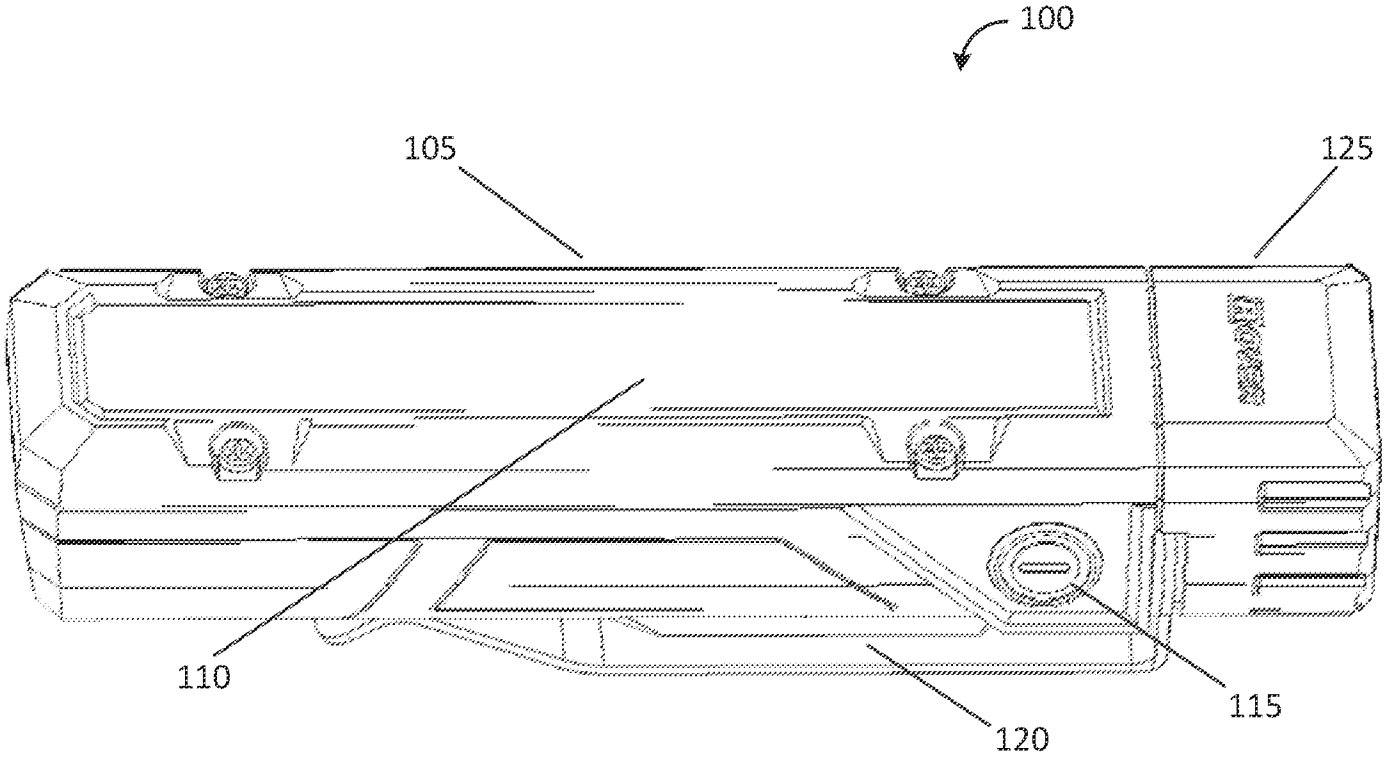
FIG. 1A is a perspective view of a portable lighting device including a light source, according to some embodiments.
Figure 1B:
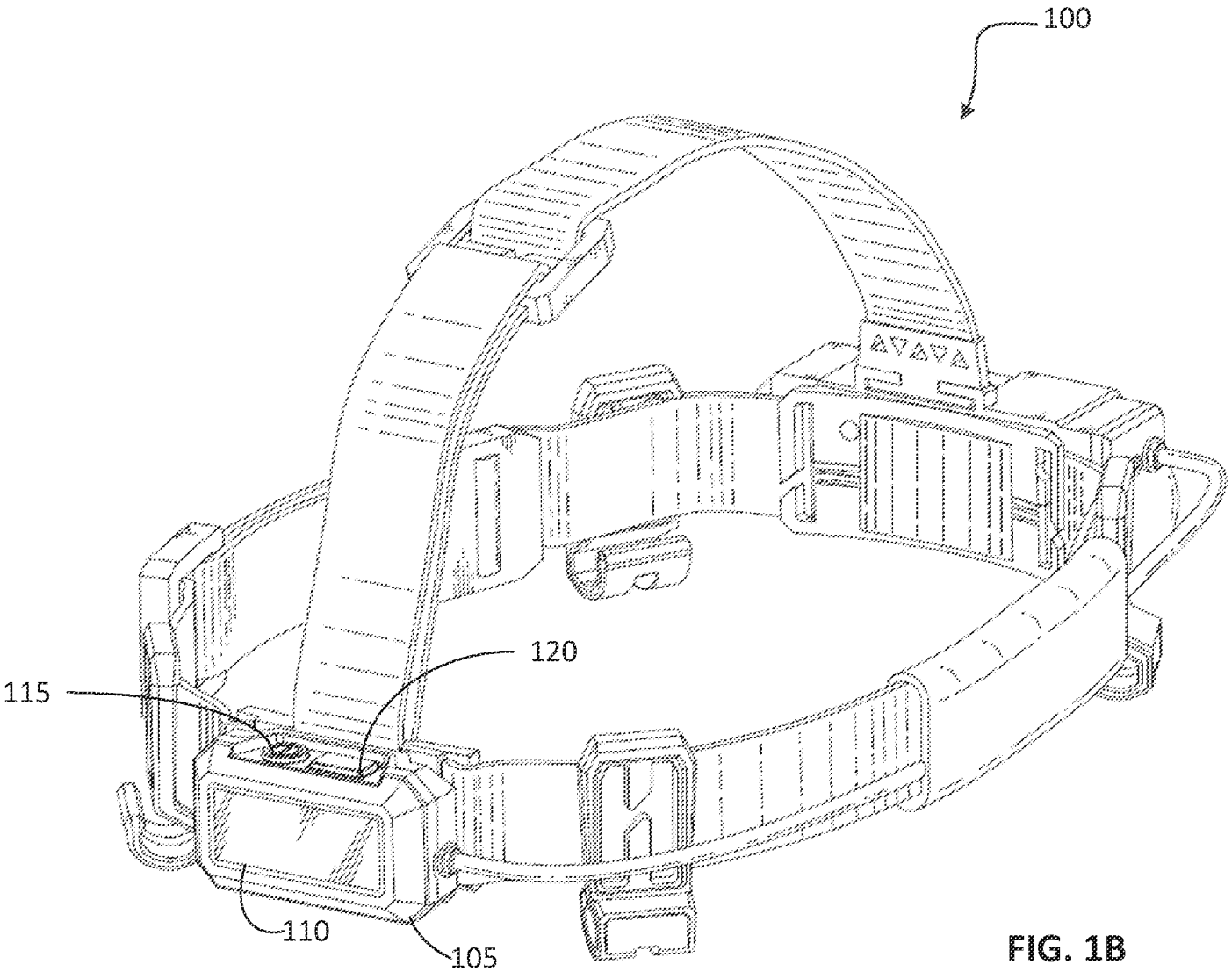
FIG. 1B is a perspective view of a headlamp lighting device including a light source, according to some embodiments.

FIG. 1A illustrates a portable lighting device 100, such as a personal floodlight or flashlight, including a housing 105, a light source 110, and a power input 115. The housing 105 has a generally elongated cuboidal shape with a rectangular or square cross-section. In other embodiments, the housing 105 may be configured as other geometric shapes. The housing 105 supports and encloses the other components of the lighting device 100. FIG. 1B shows a different embodiment of the portable lighting device 100, as a headlamp having a housing 105, a light source 110, a power input 115, and a mode input 120. The above embodiments described in FIGS. 1A and 1B are for example purposes only, and it is contemplated that other portable lighting device 100 types may be used to effectuate the below processes. Other example portable lighting device types can include headlamps, flashlights, flood lights, tower lights, site lights, temporary lights, etc.

In some embodiments, the light sources 110 may include one or more light emitting elements. In one embodiment, the light emitting elements are light emitting diodes (LEDs). The light sources 110 may include various numbers of LEDs. For example, the light sources 110 may include 1, 2, 4, or any other number of LEDs. For example, in some embodiments, the lighting device 100 may be a personal flashlight that only includes one LED. In other embodiments, the lighting device 100 may be a tower light that includes 50 or more LEDs. In the present embodiments, the LEDs are driven in synchronism with a relatively constant current or voltage. In other embodiments, the LEDs may be driven separately and with a variable current or voltage.

Figure 2:
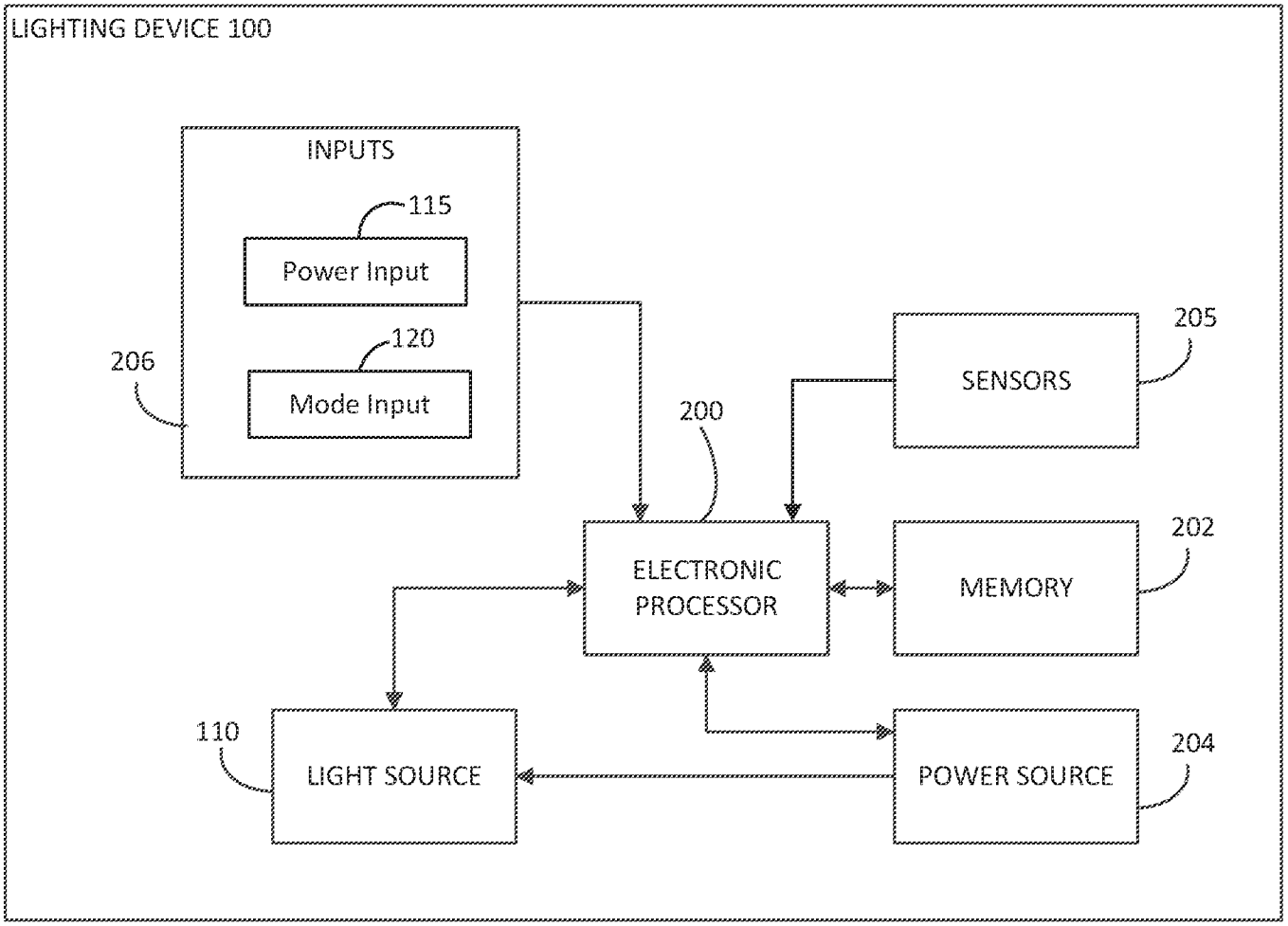
FIG. 2 is a block diagram of a lighting device, according to some embodiments.

Turning now to FIG. 2, a block diagram of the lighting device 100 is shown, according to one embodiment. As shown in FIG. 2, the lighting device 100 includes an electronic processor 200, a memory 202, a power source 204, one or more sensors 205, the light source 110, and one or more inputs 206 (e.g., power input 115 and/or mode input 120). The electronic processor 200 is electrically coupled to a variety of components of the lighting device 100 and includes electrical and electronic components that provide power, operational control, and protection to the components of the lighting device 100. In some embodiments, the electronic processor 200 includes, among other things, a processing unit (e.g., a microprocessor, a microcontroller, or another suitable programmable device), a memory, input units, and output units. The processing unit of the electronic processor 200 may include, among other things, a control unit, an arithmetic logic unit ("ALU"), and registers. In some embodiments, the electronic processor 200 may be implemented as a programmable microprocessor, an application specific integrated circuit ("ASIC"), one or more field programmable gate arrays ("FPGA"), a group of processing components, or with other suitable electronic processing components.

In some embodiments, the electronic processor 200 may include a memory 202 (for example, a non-transitory, computer-readable medium) that includes one or more devices (for example, RAM, ROM, Flash memory, hard disk storage, etc.) for storing data and/or computer code for completing or facilitating the various processes, layers, and modules described herein. The memory 202 may include database components, object code components, script components, or other types of code and information for supporting the various activities and information structures described in the present application. The electronic processor 200 is configured to retrieve from the memory 202 and execute, among other things, instructions related to the control processes, algorithms, and methods described herein. The electronic processor 200 is also configured to store information on the memory 202.

In some embodiments, the power source 204 is coupled to and transmits power to the electronic processor 200 and to the light source 110. The power source 204 may include one or more batteries, such as alkaline batteries, a power tool battery, or a dedicated battery. The batteries may be removable and/or rechargeable. In some examples, the power source 204 includes other power storage devices, such as super-capacitors or ultra-capacitors. In some embodiments, the power source 204 includes combinations of active and passive components (e.g., voltage step-down controllers, voltage converters, rectifiers, filters, etc.) to regulate or control the power provided to the electronic processor 200 and/or the light source 110. In some embodiments, the power source 204 is configured to provide a drive current to the light source 110 based on control signals received from the electronic processor 200 to control an intensity of the light source 110. In other words, an intensity of the light source 110 is dependent on the drive current (i.e., power) received from the power source 204. In some embodiments, the electronic processor 200 is configured to control the drive current provided by the power source 204 to the light source 110 by controlling a pulse width modulation ("PWM") duty cycle that controls when the power source 204 provides the drive current to the light source 110.

In one example, the electronic processor 200 is configured to detect a user actuation of one or more of the inputs 206, such as the power input 115 and/or the mode input 120, by detecting a change in the state of the inputs 206. Based on the detected user actuation, the electronic processor 200 determines an operational mode for the light source 110 (for example, a high output operation mode, a low output operation mode, an off mode, or the like). In some embodiments, the lighting device 100 may only have a power input 115. The power input 115 may be a temporary push button, a slider switch, a rotating knob, etc. Accordingly, in such embodiments, the power input 115 may provide both ON/OFF input signals, as well as allow a user to select a mode of the lighting device 100. For example, a user may actuate the power input 115 a certain number of times to switch the mode of the lighting device 100. In one embodiment, the user may quickly actuate and release the power input 115 to change modes (e.g., HIGH mode, MED mode, and LOW mode), and actuate and hold the power input 115 to power the lighting device 100 ON or OFF. Similarly, where the lighting device 100 includes a mode input 120, actuations of the mode switch can indicate a desired mode. For example, the user may actuate the mode input 120, which cycles through the available modes of the lighting device 100. Based on the selected mode, the electronic processor 200 then controls the power source 204 to provide a drive current to the light source 110 that corresponds to the selected operational mode. In some embodiments, the lighting device 100 may include a separate actuator to select each mode.

In some embodiments, one or more of the components shown in FIG. 2 may be located on a PCB. In some embodiments, one or more of the components shown in FIG. 2 may be located elsewhere within or on the housing 105 of the lighting device 100. In some embodiments, the lighting device 100 includes additional, fewer, or different components than the components shown in FIG. 2. For example, the lighting device 100 may additionally include a display to indicate an operational mode of the lighting device 100. As another example, the lighting device 100 may include one or more sensors 205, such as current and/or voltage sensors that measure the current being drawn by the light source 110 (i.e., drive current) and/or the voltage of the power source 204.

In some embodiments, the electronic processor 200 generates a pulse width modulated ("PWM") signal that drives the light source 110. In some embodiments, the electronic processor 200 may be in communication with a drive circuit that generates the PWM signal that drives the light source 110. In one embodiment, the electronic processor 200 is operable to vary the PWM duty cycle to adjust the intensities of the light source 110 depending on the operation mode (e.g., HIGH mode, MED mode, LOW mode, etc.) selected by the user via the inputs 206. In other embodiments, the electronic processor 200 or other suitable circuitry may generate different types of signals or drive currents to power the light source 110 in different modes. In some embodiments, the electronic processor 200 is operable to implement one or more ramp down operations, which allow for the output of the lighting device 100 to be gradually reduced such that a user does not perceive the change in the output. By ramping down the light source 110 of the lighting device 100, the operational life of the light emitting elements can be extended, such as due to the reduction in heat generated by the light emitting elements. Further, by reducing the output of the light source 110 of the lighting device 100, the power is further reduced, thereby extending the life of the power source 204 (e.g., the amount of time the power source 204 can supply power), where the power source 204 is a stored energy (e.g., battery) power source. Details of the ramp down processes will be described in more detail below.

In some embodiments, the power source 204 comprises one or more lithium ion battery packs. In one example, the power source 204 comprises 18V lithium ion battery packs. However, lithium ion battery packs of more than 18V or less than 18V are also considered. For example, 12 VDC, SVDC, 3.3 VDC, and/or other battery pack voltages may be used as required for a given application. In other embodiments, the power source 204 may be other energy storage devices, such as alkaline batteries, lead acid batteries, nickel metal hydride batteries, etc. In still further embodiments, the power source 204 may be an AC power source, such as provided by a utility.

Figure 3:
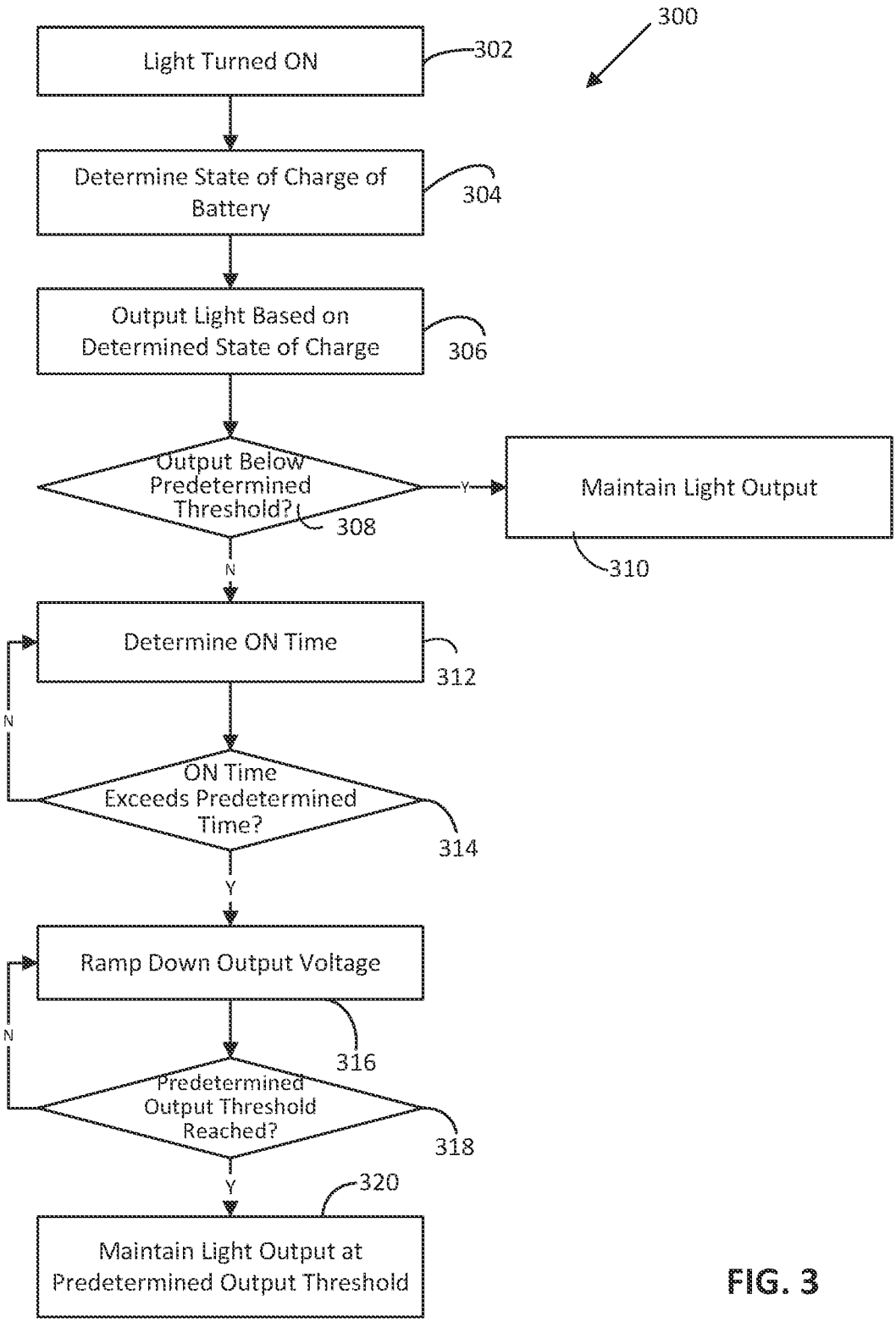
FIG. 3 is a flowchart for controlling an initial output of a lighting device, according to some embodiments.

Turning now to FIG. 3, a flowchart illustrating a process 300 for controlling the output of a light source, such as the light source 110 described above, is shown, according to some embodiments. The process 300 may be executed using the lighting device 100. At process block 302, the light source 110 is turned on, such as by a user actuating the power input 115. At process block 304 a state of charge ("SoC") of a power source, such as power source 204, is determined. In one embodiment, the SoC is determined prior to the LEDs (or other lighting elements) being powered to generate light. In one embodiment, the electronic processor 200 is configured to determine the SoC of the power source 204. For example, the electronic processor 200 may be in communication with the one or more sensors 205. For example, the one or more sensors 205 may include voltage sensors, current sensors, etc. for use in determining the SoC of the power source 204. In other embodiments, the power source 204 may provide data to the electronic processor 200 indicative of a SoC of the battery, such as voltage, current, temperature, etc. The electronic processor 200 may then determine the SoC based on the data received from the power source 204, and/or via parameters provided by the sensors 205. As noted above, the power source 204 may be a removable battery pack. In one embodiment, the SoC of the power source 204 is determined based on a voltage of the power source. However, other methods of determined SoC, such as power measurements, coulomb counting, etc., may be used to determine the SoC of the power source 204.

At process block 306, the electronic processor 200 controls the light source 110 to output a first illumination value based on the determined state of charge. In one embodiment, the output may be equivalent to a percentage of SoC available in the power source 204. For example, where the power source 204 is determined to be at 75% SoC, then the output illumination from the light source 110 is set to 75% of a non-reduced output. This correlation of illumination output to determined SoC may be followed from 100% SoC down to 0% SoC. However, in other embodiments, a cutoff point may be set such that the illumination output plateaus at a level in response to the SoC falling below a certain level. For example, where the SoC falls below 25%, the illumination output may remain at 25% until the power source 204 is no longer able to power the light source 110. It is understood that 25% is an example value, and that values of more than 25% or less than 25% are contemplated.

In other embodiments, the light output at process block 306 is based on the determined SoC being determined to be within one or more predefined ranges. For example, the predefined ranges may be in increments of 25% (e.g., 100%-75%; 75%-50%; 50%-25%; 25%-0%). A light output level may be associated with each of the predefined ranges. For example, where the SoC is in a first range (e.g., 100%-75%) then the light output may be 100% when the light is turned ON, and where the SoC is in a second range (e.g., 75%-50%) the light output may be a reduced value, such as 75% when the lighting device 100 is turned ON. This may continue for each of the remaining SoC ranges. It is understood that the above described predefined ranges and their associated light outputs are for illustrative purposes only, and that more or fewer predefined ranges, different range value, and different illumination outputs are contemplated and may be provided based on an application and/or lighting device type.

At process block 308, the electronic processor 200 determines whether the light output is below a predetermined threshold. For example, the predetermined threshold may be a minimum ramp-down plateau value, as described below. In other examples, the predetermined threshold may be a predetermined minimum normal operating value. In response to determining that the light output is below the predetermined threshold, the light output level determined in process block 306 is maintained at process block 310. In response to determining that the light output is not below the predetermined threshold, the electronic processor 200 determines an ON time of the light source 110 at process block 312. In some embodiments, the electronic processor 200 is configured to start a timer as soon as the light is turned on at process block 302.

At process block 314, the electronic processor 200 determines whether the ON time exceeds a predetermined time value. In one embodiment, the predetermined time value may be 10 seconds. However, predetermined time values of more than 10 seconds or less than 10 seconds are also contemplated. In response to the electronic processor 200 determining that the ON time has not exceeded the predetermined time, the electronic processor 200 continues to determine the ON time of the light source 110 at process block 312. In response to determining that the ON time has exceeded the predetermined time, the electronic processor 200 initiates a ramp-down algorithm to reduce the output of the light source 110 at process block 316.

In one embodiment, the ramp-down algorithm may be implemented by the electronic processor 200 to slowly decrease the drive current and the corresponding lumen output of the light source 110 as a function of time. In other embodiments, the electronic processor 200 decreases the drive current and the corresponding lumen output of the light source 110 as a function of remaining charge in the power source 204 or as a function of both time and remaining charge. In one embodiment, the electronic processor 200 decreases the drive current by reducing the percentage of the PWM duty cycle provided to the light source 110. In other embodiments, the ramp-down algorithm instructs the electronic processor 200 to decrease drive current to the light source 110 until a specific "plateau" threshold is reached, after which the drive current is held constant by the electronic processor 200. In some embodiments, the ramp-down algorithm is implemented by the electronic processor 200 to incrementally decrease the drive current in a predetermined number of steps or as a continuous function with zero or infinite number of steps. In some embodiments, the ramp-down algorithm may use linear slopes, mathematical functions, or look up tables to determine the ramp. Other methods of implementing the ramp-down algorithm based on factors other than time are possible to achieve the same purpose and are not exhaustively detailed herein.

At process block 318 the electronic processor 200 determines whether the light output has reached a predetermined output threshold (e.g., plateau value described above). The predetermined output thresholds may be any number of output threshold value. In one embodiment, the output threshold is 75%. However, values of more than 75% or less than 75% may also be used. In response to determining that the light output has not reached the predetermined output threshold, the electronic processor 200 continues to ramp down the output voltage at process block 316. In response to determining that the light output has reached the predetermined output threshold, the light output is maintained at the predetermined output threshold at process block 320.

Figure 4:
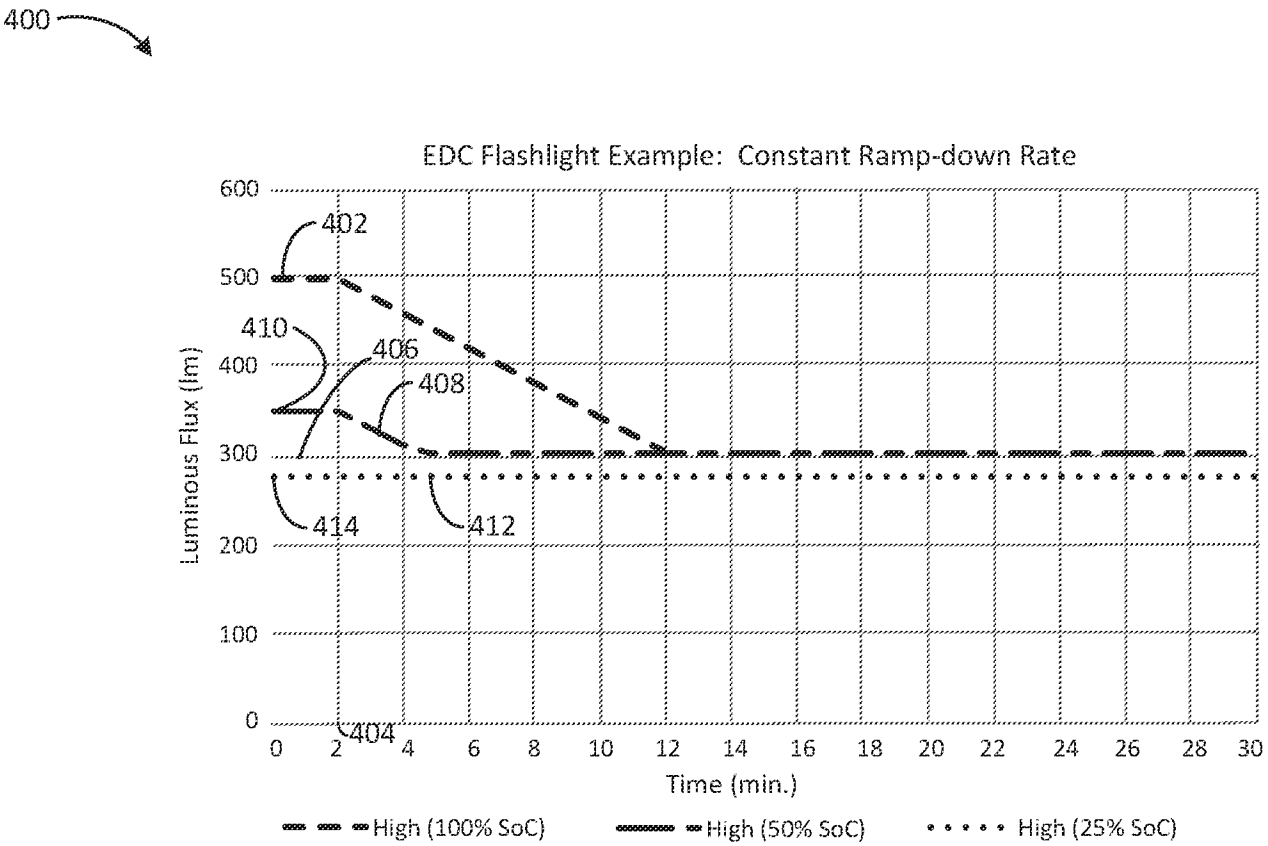
FIG. 4 is a graph of a light output during execution of the algorithm of FIG. 3, according to some embodiments.

Turning now to FIG. 4, a graph illustrating various illumination outputs from a lighting device, such as lighting device 100, using the process 300 described above, is shown according to some embodiments. As shown in FIG. 4, a first output 402 illustrates the light output of the light source 110 where the SoC of the power source 204 is 100%. The first output 402 is a full (100%) output value, and after a predetermined time 404, begins the ramp down as described above. The ramp down continues until the light output reaches the predetermined value 406. A second output 408 illustrates the output of the light source 110 where the SoC of the power source 204 is 50%. The second output 408 is output initially at a first reduced output value 410, as described above, and after the predetermined time 404 expires, begins the ramp down process as described above. The ramp down continues until the light output reaches the predetermined value 406. A third output 412 illustrates the output of the light source 110 where the SoC of the power source 204 is 25%. The third output 412 is output at a second reduced value 414, as described above, and as the second reduced value 414 is below the predetermined value 406, the output is maintained at the second reduced value 414 until the power source 204 is exhausted or the light is turned OFF.

Figure 5:
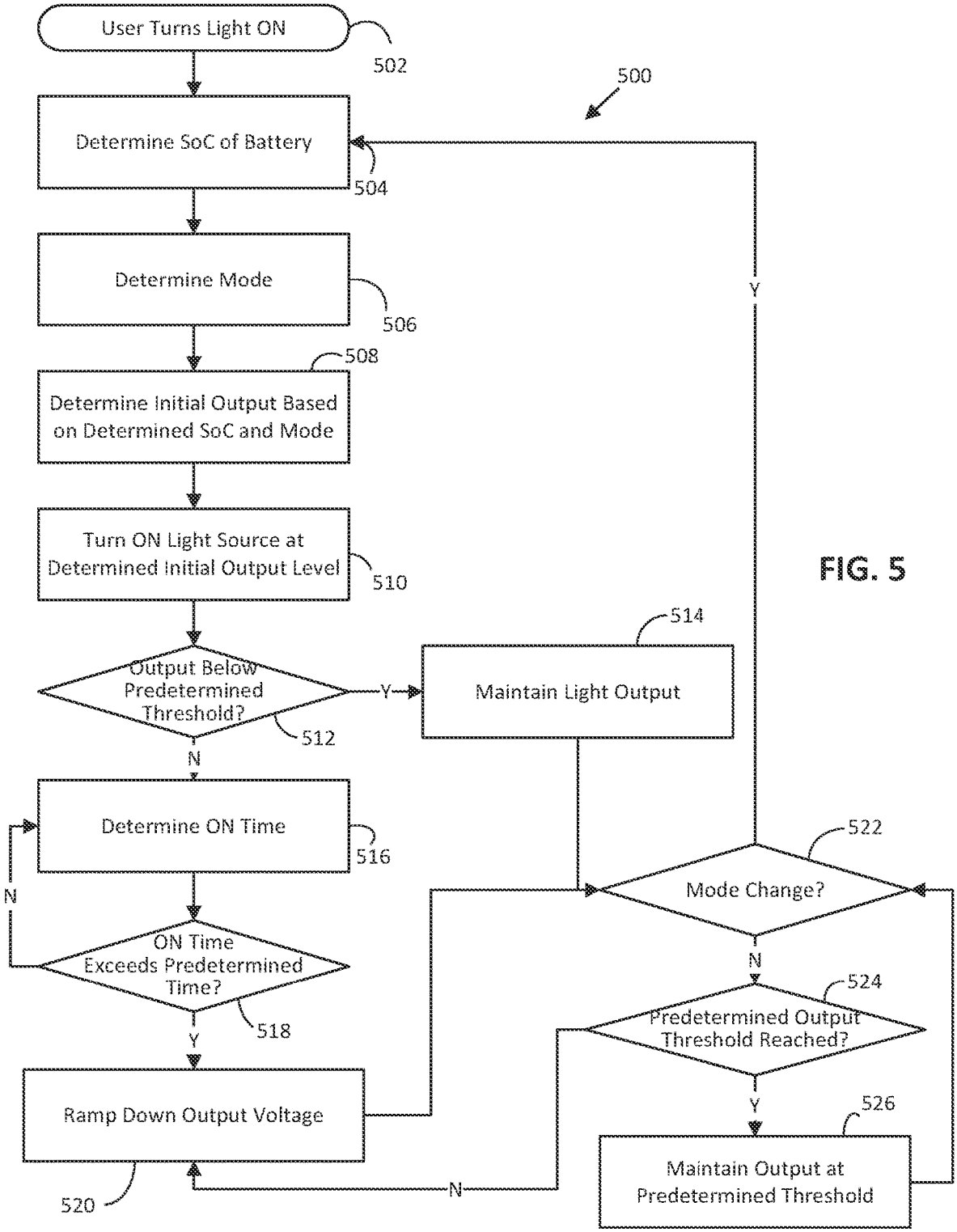
FIG. 5 is a flow chart illustrating a process for controlling an output of a lighting device based on a state-of-charge and selected operating mode, according to some embodiments.

Turning now to FIG. 5, a flowchart illustrating a process 500 for controlling the output of a light source having multiple illumination modes, such as the light source 110 described above, is shown, according to some embodiments. The process 500 may be executed using the lighting device 100. At process block 502, the light source 110 is turned on, such as by a user actuating the power input 115. At process block 504, the SoC of a power source, such as power source 204, is determined. In one embodiment, the electronic processor 200 is configured to determine the SoC of the power source 204. For example, the electronic processor 200 may be in communication with the one or more sensors 205 to determine the SoC of the power source 204. In other embodiments, the power source 204 may provide data to the electronic processor 200 indicative of a SoC of the battery, such as voltage, current, temperature, etc. The electronic processor 200 may then determine the SoC based on the data received from the power source 204, and/or via parameters provided by the sensors 205. As noted above, the power source 204 may be a removable battery pack. In one embodiment, the SoC of the power source 204 is determined based on a voltage of the power source. However, other methods of determined SoC, such as power measurements, coulomb counting, etc. may be used to determine the SoC of the power source 204. In one embodiment, the SoC is determined prior to the LEDs (or other lighting elements) being powered to generate light.

At process block 506, the electronic processor 200 determines a mode of the lighting device 100. The mode may be selected by a user via the mode input 120 or using other techniques to select the mode as described above. The modes may include a HIGH mode, a MEDIUM mode, and a LOW mode. Each of the above modes may be associated with an initial output level. For example, HIGH mode may be associated with a 100% output, MEDIUM mode may be associated with a 75% output, and LOW mode may be associated with a 50% output. However, the above values are for example purposes only and it is understood that various values may be associated with the above modes. In some embodiments, the modes may alternatively (or additionally) be operational modes, such as a hybrid mode (e.g., flood and spotlight), a spot high mode, a spot low mode, a flood high mode, a flood low mode, etc. The operational modes may be associated with an initial illumination output, similar to the HIGH, MEDIUM, LOW nodes described above.

At process block 508, the electronic processor 200 determines an initial illumination output based on the determined SoC of the power source 204 and the determined mode. In one embodiment, the initial illumination output may be equivalent to a percentage of the SoC available in the power source 204 as a function of the selected mode. For example, where the SoC is 90% and the mode is a HIGH mode, then the initial output may be 90% (90% of the 100% associated with the HIGH mode.) Similarly, where the SoC is 90% and the mode is the MEDIUM mode, the output may be 67.5% (90% of 75%). The above calculations are for exemplary purposes only, and it is understood that various initial outputs may be determined based on the SoC of the power source 204 and the selected mode. At process block 510, the light source 110 is turned on at the determined initial output level.

At process block 512, the electronic processor 200 determines whether the light output is below a predetermined threshold. For example, the predetermined threshold may be a minimum ramp-down plateau value, as described herein. In other examples, the predetermined value may be a predetermined minimum operating value. In response to determining that the light output is below the predetermined threshold, the light output level is maintained at process block 514 at the level determined in process block 508. In response to determining that the light output is not below the predetermined threshold, the electronic processor 200 determines an ON time of the light source 110 at process block 516. In some embodiments, the electronic processor 200 is configured to start a timer as soon as the light is turned on at process block 502.

At process block 518, the electronic processor 200 determines whether the ON time exceeds a predetermined time value. In one embodiment, the predetermined time value may be 10 seconds. However, predetermined time values of more than 10 seconds or less than 10 seconds are also contemplated. In response to the electronic processor 200 determining that the ON time has not exceeded the predetermined time, the electronic processor 200 continues to determine the ON time of the light source 110 at process block 516. In response to determining that the ON time has exceeded the predetermined time, the electronic processor 200 initiates a ramp-down algorithm to reduce the output of the light source 110 at process block 520.

In one embodiment, the ramp-down algorithm may be implemented by the electronic processor 200 to slowly decrease the drive current and the corresponding lumen output of the light source 110 according to a function of time. In other embodiments, the electronic processor 200 decreases the drive current and the corresponding lumen output of the light source 110 as a function of remaining charge in the power source 204 or a function of both time and remaining charge. In one embodiment, the electronic processor 200 decreases the drive current by reducing the percentage of the PWM duty cycle provided to the light source 110. In one embodiment, the ramp-down algorithm instructs the electronic processor 200 to decrease drive current to the light source 110 until a specific "plateau" threshold is reached, after which the drive current is held constant by the electronic processor 200. In some embodiments, the ramp-down algorithm is implemented by the electronic processor 200 to incrementally decrease the drive current in a predetermined number of steps or as a continuous function with zero or infinite number of steps. In some embodiments, the ramp-down algorithm may use linear slopes, mathematical functions, or look up tables to determine the ramp. Other methods of implementing the ramp-down algorithm based on factors other than time are possible to achieve the same purpose and are not exhaustively detailed herein.

At process block 522, the electronic processor 200 determines whether a mode change has occurred. In some examples, a mode change may include turning the light source 110 to an OFF condition. In response to determining that a mode change has occurred, the process 500 returns to process block 504 to determine the SoC of the power source 204 and continues to perform the process steps described above. In some embodiments, the electronic processor 200 may wait a predetermined time after the mode change occurs to measure the SoC of the power source 204 to allow the power source 204 to equalize. In one example, the predetermined time is 200 ms. However, predetermined times of more than 200 ms or less than 200 ms are also contemplated. In response to determining that a mode change has not occurred, the electronic processor 200 determines whether the predetermined output threshold value has been reached at process block 524. The predetermined output threshold may be any number of output threshold values. In one embodiment, the output threshold is 75% of a given mode. However, values of more than 75% or less than 75% may also be used. In response to determining that the light output has not reached the predetermined output threshold, the electronic processor 200 continues to ramp down the output voltage at process block 520. In response to determining that the light output has reached the predetermined output threshold, the light output is maintained at the predetermined output threshold at process block 526.

Figure 6:
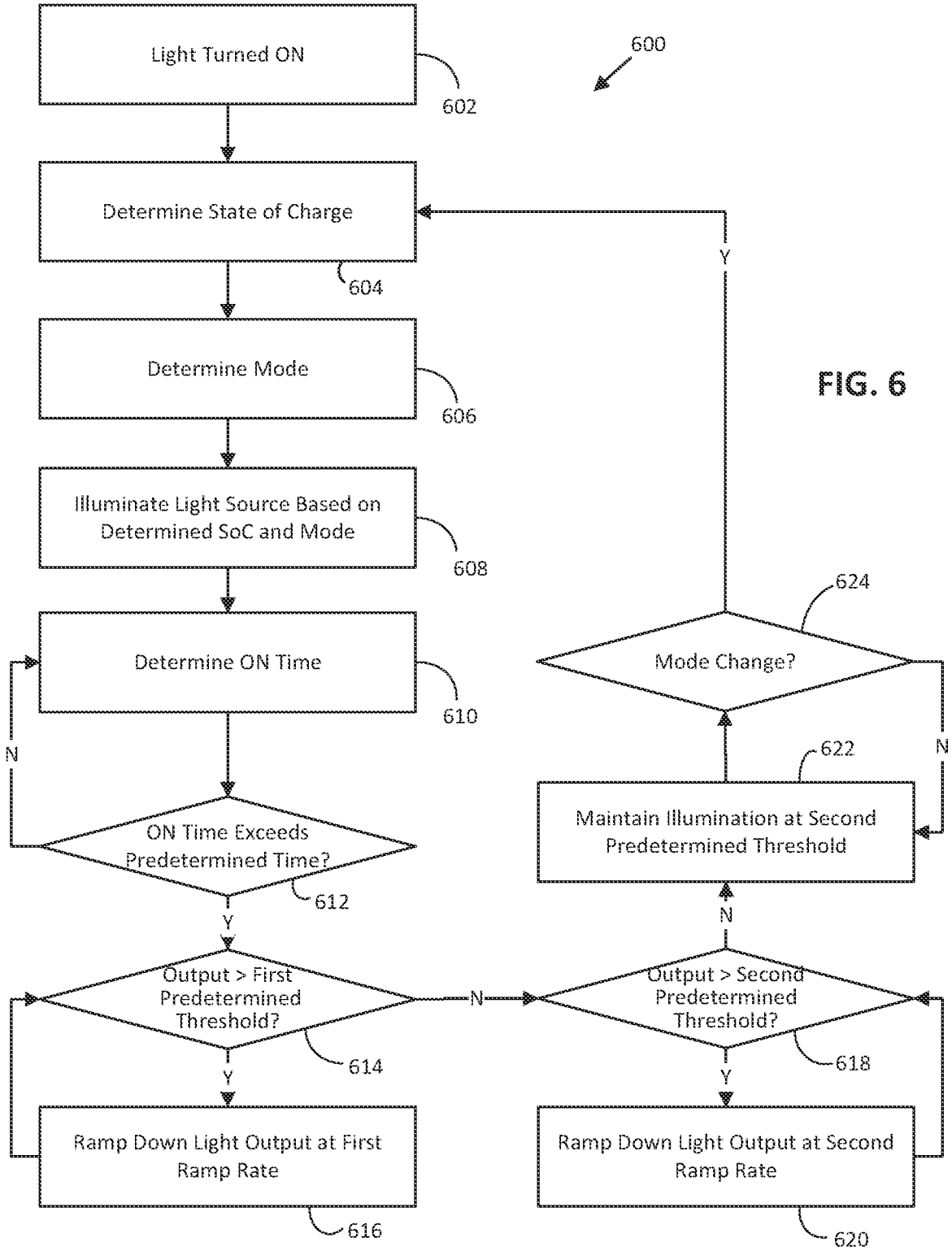
FIG. 6 is a flow chart illustrating an alternative process for controlling an output of a lighting device based on a state-of-charge and selected operating mode, according to some embodiments.

Turning now to FIG. 6, a flowchart illustrating a process 600 for controlling the output of a light source, such as the light source 110 described above, is shown, according to some embodiments. The process 600 may be executed using the lighting device 100. At process block 602, the light source 110 is turned on, such as by a user actuating the power input 115. At process block 604 the SoC of a power source, such as power source 204, is determined. In one embodiment, the electronic processor 200 is configured to determine the SoC of the power source 204. For example, the electronic processor 200 may be in communication with the one or more sensors 205 for use in determining the SoC of the power source 204. In other embodiments, the power source 204 may provide data to the electronic processor 200 indicative of a SoC of the battery, such as voltage, current, temperature, etc. The electronic processor 200 may then determine the SoC based on the data received from the power source 204, and/or via parameters provided by the sensors 205. As noted above, the power source 204 may be a removable battery pack. In one embodiment, the SoC of the power source 204 is determined based on a voltage of the power source 204. However, other methods of determined SoC, such as power measurements, coulomb counting, etc. may be used to determine the SoC of the power source 204. In one embodiment, the SoC is determined prior to the LEDs (or other lighting elements) being powered to generate light.

At process block 606, the electronic processor 200 determines a mode of the lighting device 100. The mode may be selected by a user via the mode input 120 or using other techniques to select the mode as described above. The modes may include a HIGH mode, a MEDIUM mode, and a LOW mode. However, other modes are contemplated as required for a given application. Each of the above modes may be associated with an initial output level. For example, HIGH mode may be associated with a 100% output, MEDIUM mode may be associated with a 75% output, and LOW mode may be associated with a 50% output. However, the above values are for example purposes only and it is understood that various values may be associated with the above modes. In some embodiments, the modes may alternatively (or additionally) be operational modes, such as a hybrid mode (e.g., flood and spotlight), a spot high mode, a spot low mode, a flood high mode, a flood low mode, etc. The operational modes may be associated with an initial illumination output, similar to the HIGH, MEDIUM, LOW modes described above.

At process block 608, the electronic processor 200 illuminates the light source 110 with an initial illumination output based on the determined SoC and mode. In one embodiment, the initial illumination output may be equivalent to a percentage of the SoC available in the power source 204 as a function of the selected mode. For example, where the SoC is 90% and the mode is a HIGH mode, then the initial output may be 90% (90% of the 100% associated with the HIGH mode.) Similarly, where the SoC is 90% and the mode is the MEDIUM mode, the output may be 67.5% (90% of 75%). The above calculations are for exemplary purposes only, and it is understood that various initial outputs may be determined based on the SoC of the power source 204 and the selected mode.

At process block 610, the electronic processor 200 determines an ON time of the light source 110. In some embodiments, the electronic processor 200 is configured to start a timer as soon as the light is turned on at process block 602. At process block 612, the electronic processor 200 determines whether the ON time exceeds a predetermined time value. In one embodiment, the predetermined time value may be 10 seconds. However, predetermined time values of more than 10 seconds or less than 10 seconds are also contemplated. In response to the electronic processor 200 determining that the ON time has not exceeded the predetermined time, the electronic processor 200 continues to determine the ON time of the light source 110 at process block 610.

In response to determining that the ON time has exceeded the predetermined time, the electronic processor 200 determines whether the illumination output is greater than a first predetermined threshold. In one embodiment, the first predetermined threshold may be associated with the determined mode. For example, the first predetermined threshold may be a percentage of the maximum mode output (e.g., 80%). However, other first predetermined threshold values are contemplated, and are shown in more detail in FIG. 7. In response to determining that the illumination output is greater than the first predetermined threshold, the electronic processor 200 initiates a first ramp-down algorithm to reduce the output of the light source 110 at process block 616. The first ramp-down algorithm is associated with a first ramp rate (e.g., decrease in light output over time).

In one embodiment, the first ramp-down algorithm may be implemented by the electronic processor 200 to slowly decrease the drive current and the corresponding lumen output of the light source 110 according to a function of time. In other embodiments, the electronic processor 200 decreases the drive current and the corresponding lumen output of the light source 110 as a function of remaining charge in the power source 204 or a function of both time and remaining charge. In one embodiment, the electronic processor 200 decreases the drive current by reducing the percentage of the PWM duty cycle provided to the light source 110. In other embodiments, the ramp-down algorithm instructs the electronic processor 200 to decrease drive current to the light source 110 until a specific "plateau" threshold is reached, after which the drive current is held constant by the electronic processor 200. In some embodiments, the first ramp-down algorithm is implemented by the electronic processor 200 to incrementally decrease the drive current in a predetermined number of steps or as a continuous function with zero or infinite number of steps. In some embodiments, the first ramp-down algorithm may use linear slopes, mathematical functions, or look-up tables to determine the ramp. Other methods of implementing the first ramp-down algorithm based on factors other than time are possible to achieve the same purpose and are not exhaustively detailed herein.

After initiating the first ramp-down algorithm, the electronic processor 200 continues to determine whether the illumination output is greater than the first predetermined threshold at process block 614. In response to determining that the illumination output is not greater than the first predetermined threshold, the electronic processor 200 then determines whether the illumination output is greater than a second predetermined threshold at process block 618. In one embodiment, the second predetermined threshold is less than the first illumination threshold. For example, the second predetermined threshold may be a percentage of the maximum mode output that is less than the first predetermined threshold. In one specific example, the second predetermined threshold may be 60% of the maximum mode output. However, it is understood that the second predetermined threshold may be more than 60% of the maximum mode output or less than 60% of the maximum mode output.

In response to determining that the illumination output is greater than the second predetermined threshold, the electronic processor 200 initiates a second ramp-down algorithm to reduce the output of the light source 110 at process block 620. The second ramp-down algorithm is associated with a second ramp rate (e.g., decrease in light output over time). In one example, the second ramp rate is steeper (e.g., greater decrease over time) than the first ramp rate. In other examples, the second ramp rate is less steep (e.g., less decrease over time) than the first ramp rate.

In one embodiment, the second ramp-down algorithm may be implemented by the electronic processor 200 to slowly decrease the drive current and the corresponding lumen output of the light source 110 according to a function of time. In other embodiments, the electronic processor 200 decreases the drive current and the corresponding lumen output of the light source 110 as a function of remaining charge in the power source 204 or as a function of both time and remaining charge. In one embodiment, the electronic processor 200 decreases the drive current by reducing the percentage of the PWM duty cycle provided to the light source 110. In some embodiments, the second ramp-down algorithm is implemented by the electronic processor 200 to incrementally decrease the drive current in a predetermined number of steps or as a continuous function with zero or infinite number of steps. In some embodiments, the second ramp-down algorithm may use linear slopes, mathematical functions, or look up tables to determine the ramp. Other methods of implementing the second ramp-down algorithm based on factors other than time are possible to achieve the same purpose and are not exhaustively detailed herein. The second ramp-down algorithm may use the same or different type of ramp-down algorithm as compared to the first ramp-down algorithm.

After initiating the second ramp-down algorithm, the electronic processor 200 continues to determine whether the illumination output is greater than the first predetermined threshold at process block 618. In response to determining that the illumination output is not greater than the second predetermined threshold, the electronic processor 200 then maintains the illumination output at the second predetermined threshold at process block 622. Where the illumination output is determined to be less than the second predetermined threshold, the output illumination is maintained at the level below the second predetermined threshold at process block 622. The electronic processor 200 then determines whether a mode change occurs at process block 624. In some examples, a mode change may include turning the light source 110 to an OFF condition. In response to determining a mode change has occurred, the electronic processor 200 returns to process block 604 of the process 600. In some embodiments, the electronic processor 200 may wait a predetermined time after the mode change occurs to measure the SoC of the power source 204 to allow the power source 204 to equalize. In one example, the predetermined time is 200 ms. However, predetermined times of more than 200 ms or less than 200 ms are also contemplated. In response to determining that a mode change has not occurred, the electronic processor 200 maintains the illumination level at process block 622, as described above. The electronic processor 200 maintains the illumination level at process block 622 until the light is turned off or the power source 204 is exhausted.

Figure 7A:
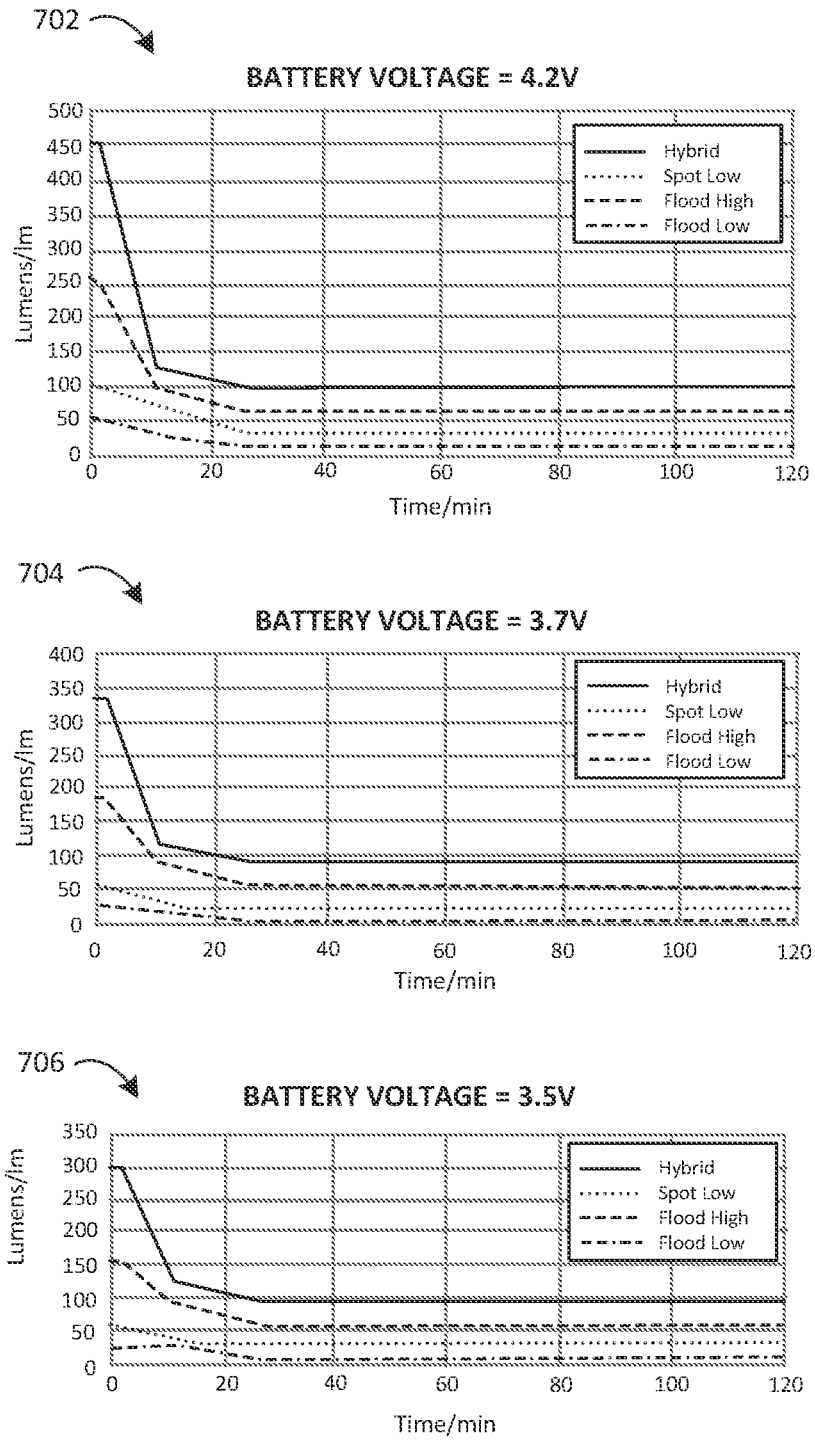
FIGS. 7A-7B are graphs of light outputs during execution of the process of FIG. 6 for varying power source states-of-charge, according to some embodiments.
Figure 7B:
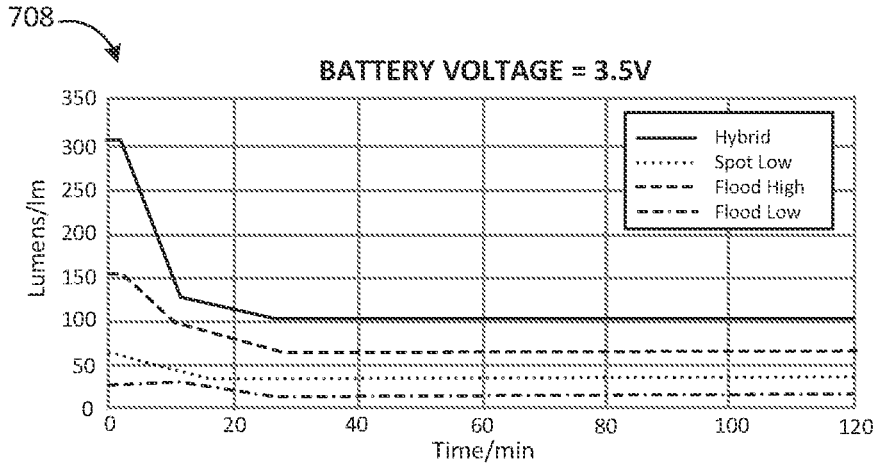
Figure 7B:
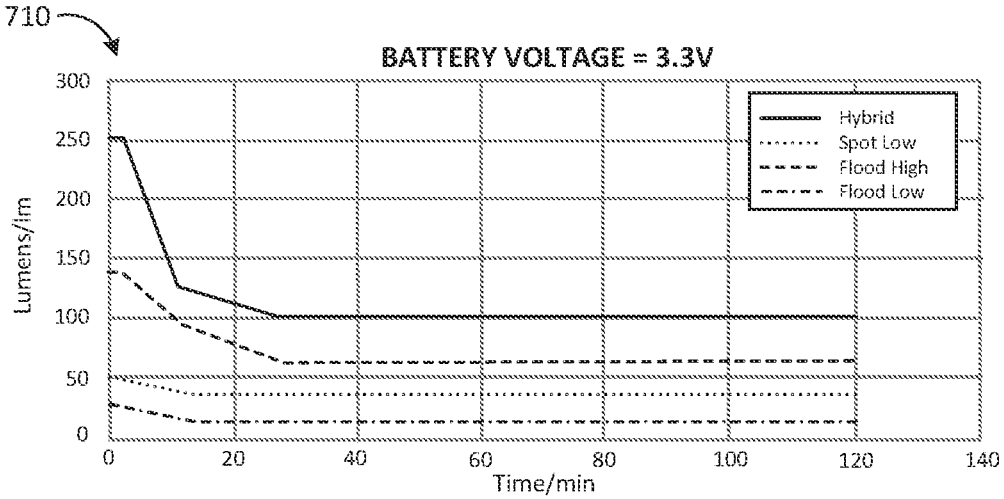
Figure 7B:
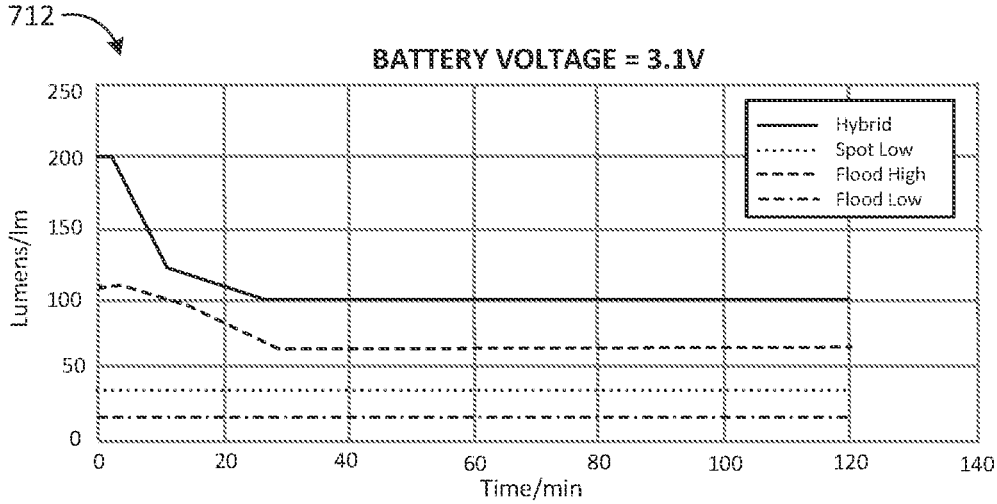

Turning now to FIGS. 7A-7B, a number of graphs illustrating the output of a lighting device utilizing the process 600 are shown. In the first graph 702, the SoC of the power source 204 is determined to be 100%. For each of the modes shown in first graph 702, the initial output is the full output value for each of the modes. The light outputs for each mode are then ramped down as described in process 600. Turning now to the second graph 704, the SoC of the power source 204 is determined to be approximately 93%. Accordingly, the initial output for each of the modes is reduced based on the reduced SoC. Similar reductions in initial output and subsequent ramp down operations are shown in third graph 706 (88% SoC), fourth graph 708 (83%), fifth graph 710 (79%), and sixth graph (74%). As shown in certain graphs, such as sixth graph 712, the initial values of the Flood High mode and the Flood Low mode are below the predetermined thresholds, and thus are not ramped down, but remain constant at the initially reduced output, as described above in regards to process 600.

Although the invention has been described in detail with reference to certain preferred embodiments, variations and modifications exist within the scope and spirit of one or more independent aspects as described. Various features and advantages are set forth in the following claims.

The invention claimed is:

1. A lighting device, comprising:

a light source;

an input device;

a power source configured to provide power to the lighting device; and one or more electronic processors configured to:

receive an input signal to illuminate the light source from the at least one input device;

determine a first state-of-charge of the power source;

determine a first illumination output value based on the determined first state of charge;

initiate a first ramp-down operation of the light source from the first illumination output value, wherein the first ramp-down operation is configured to reduce an output of the light source as a percentage of the first illumination output value over time; and continue the first ramp-down operation until the output of the light source reaches a predetermined illumination intensity.

2. The lighting device of claim 1, wherein the first illumination output value is determined as a function of the percentage of the first state-of-charge of the power source.

3. The lighting device of claim 1, wherein the first illumination output value is determined based on the first state-of-charge falling within a predetermined range of state-of-charge values of the power source.

4. The lighting device of claim 1, wherein the power source is a rechargeable power tool battery.

5. The lighting device of claim 1, wherein the first illumination output value is further based on a first operating mode received from the input device.

6. The lighting device of claim 5, wherein the one or more electronic processors are further configured to:

receive a first mode change input to change from the first operating mode to a second operating mode at a first time, wherein a second illumination output value is associated with the second operating mode;

determine, in response to receiving the first mode change input, a second state-of-charge of the power source; and control the output of the light source to output a third illumination output value, wherein the third illumination output value is based on the second illumination output value and the determined second state-of-charge.

7. The lighting device of claim 6, wherein the one or more electronic processors are further configured to:

initiate a second ramp-down operation of the light source from the third illumination output value, wherein the second ramp-down operation is configured to reduce the output of the light source as a percentage of the third illumination output value value over time.

8. The lighting device of claim 1, wherein the one or more electronic processors are further configured to determine an operating time of the light source while operating the light source at the first illumination output value, wherein the initiation of the first ramp-down operation is based on the operating time of the light source exceeding a predetermined time value.

9. The lighting device of claim 1, wherein the one or more electronic processors are further configured to control an output of the light source to output the first illumination output value.

10. A method for operating a light source, the method comprising:

receiving an input to illuminate the light source at a first illumination output value associated with a first operating mode;

determining a first state-of-charge of a power source configured to provide power to the light source;

operating the light source at a second illumination output value based on the first operating mode and the first state-of-charge;

initiating a first ramp-down operation of the light source from the second illumination output value, wherein the first ramp-down operation is configured to reduce an output value of the light source as a percentage of the second illumination output value over time;

receiving a first mode change input to change from the first operating mode to a second operating mode at a first time, wherein a third illumination output value is associated with the second operating mode;

in response to receiving the first mode change input, determining a second state-of-charge of the power source, and controlling the output of the light source to output a fourth illumination output value, wherein the fourth illumination output value is based on the third illumination output value and the determined second state-of-charge; and initiating a second ramp-down operation of the light source from the fourth illumination output value, wherein the second ramp-down operation is configured to reduce the output of the light source as a percentage of the fourth illumination output value over time.

11. The method of claim 10, wherein continuing the ramp-down operation includes continuing the ramp-down operation until the output of the light source reaches a predetermined value.

12. The method of claim 10, wherein the second illumination output value is equal to the first illumination value less a percentage equal to the first state-of-charge of the power source.

13. The method of claim 10, wherein the fourth illumination output value is equal to the third illumination output value less a percentage equal to the second state-of-charge of the power source.

14. The method of claim 10, further comprising determining an operating time of the light source while operating the light source at the second illumination output value, and wherein initiating the ramp-down operation includes initiating the ramp-down operation of the light source based on the operating time of the light source exceeding a predetermined time value.

15. The method of claim 10, wherein the power source is a rechargeable power tool battery.

16. A method for operating a light source, the method comprising:

receiving an input to illuminate the light source at a first illumination output value associated with a first operating mode;

determining a state-of-charge of a power source configured to provide power to the light source;

operating the light source at a second illumination output value based on the first operating mode and the determined state-of-charge;

determining whether the second illumination output value exceeds a first predetermined threshold;

in response to determining that the second illumination output value exceeds the first predetermined threshold, initiating a first ramp-down operation of the light source from the second illumination output value, wherein the first ramp-down operation is configured to reduce an output of the light source as a percentage of the second illumination output value over time;

in response to determining that the second illumination output value does not exceed the first predetermined threshold, determining whether the second illumination output value exceeds a second predetermined threshold;

in response to determining that the second illumination output value exceeds the second predetermined threshold, initiating a second ramp-down operation of the light source from the second illumination output value, wherein the second ramp-down operation is configured to reduce an output of the light source as a percentage of the second illumination output value over time; and in response to determining that the second illumination output value does not exceed the second predetermined threshold, maintaining the second illumination output value.

17. The method of claim 16, wherein the second illumination output value is equal to the first illumination output value less a percentage equal to the state-of-charge of the power source.

18. The method of claim 16, wherein the second illumination output value is determined based on the state-of-charge falling within a predetermined range of state-of-charge values.

19. The method of claim 16, wherein the second ramp-down operation reduces the output of the light source at a rate faster than the first ramp-down operation.

20. The method of claim 16, wherein the second predetermined value is less than the first predetermined value.

21. The method of claim 16, wherein the power source is a rechargeable power tool battery.

* * * * *